US006222500B1

(12) United States Patent
Koitsalu et al.

(10) Patent No.: US 6,222,500 B1
(45) Date of Patent: Apr. 24, 2001

(54) DEVICE FOR IMPEDANCE ADAPTION

(75) Inventors: Evald Arvid Koitsalu, Huddinge; Lars Wallin, Bromma, both of (SE)

(73) Assignee: Telefonaktiebolaget LM Ericsson (publ) (SE)

( * ) Notice: Subject to any disclaimer, the term of this patent is extended or adjusted under 35 U.S.C. 154(b) by 0 days.

(21) Appl. No.: 09/306,144

(22) Filed: May 6, 1999

(30) Foreign Application Priority Data

May 8, 1998 (SE) ..... 9801611

(51) Int. Cl.[7] ..... H01Q 1/50
(52) U.S. Cl. ..... 343/864; 333/33
(58) Field of Search ..... 343/864, 863, 343/786; 333/35, 34, 33

(56) References Cited

U.S. PATENT DOCUMENTS

| | | | | |
|---|---|---|---|---|
| 2,438,915 | * | 6/1948 | Hansen | 343/864 |
| 2,518,665 | * | 8/1950 | Collard | 343/864 |
| 2,531,437 | * | 11/1950 | Johnson et al. | 343/864 |
| 2,533,239 | * | 12/1950 | Gent et al. | 343/786 |
| 2,767,380 | * | 10/1956 | Zobel | 333/35 |
| 3,157,845 | * | 11/1964 | White | 333/21 |
| 3,909,755 | * | 9/1975 | Kaunzinger | 333/73 |
| 4,617,539 | * | 10/1986 | O'Shea et al. | 333/164 |
| 4,694,264 | * | 9/1987 | Owens et al. | 333/34 |
| 5,065,819 | | 11/1991 | Kasevich | 166/248 |
| 5,369,367 | * | 11/1994 | Eisenhart | 324/632 |
| 5,508,669 | * | 4/1996 | Sugawara | 333/206 |
| 5,563,615 | | 10/1996 | Tay et al. | 343/749 |
| 5,847,625 | | 12/1998 | Gillette | 333/127 |

FOREIGN PATENT DOCUMENTS

| | | |
|---|---|---|
| 0 359 361 A1 | 3/1990 | (EP) . |
| WO 97/30489 | 8/1997 | (WO) . |

* cited by examiner

*Primary Examiner*—Don Wong
*Assistant Examiner*—Trinh Vo Dinh
(74) *Attorney, Agent, or Firm*—Jenkens & Gilchrist

(57) ABSTRACT

The present invention relates to an impedance-matching device of antenna units, and in particular to antenna-matching in small radio units. An impedance-matching device is arranged in a radio equipment having an antenna, between said antenna and a feeding unit, e.g. an output power unit, the impedance quotient of which units exceeding a factor 3. The invented impedance-matching includes at least two quarter-wave transformers connected in series, which consist of a dielectric material having a dielectric coefficient ∈, the value of which is exceeding a factor 10. The device may be made with dimensions so small that it may be integrated with the antenna to an antenna unit and despite the small dimensions, good frequency characteristics are achieved, such as good precision, easy tuning and sufficiently broad bandwidth.

10 Claims, 6 Drawing Sheets

DEVICE FOR IMPEDANCE ADAPTION

TECHNICAL FIELD OF THE INVENTION

The present invention generally relates to impedance matching of antenna units, and particularly to matching of antennas in small radio units.

BACKGROUND OF THE INVENTION

Radio units, and especially small radio units for mobile radio communication, are occasionally equipped with small antennas. This means that the center of radiation and the most powerful field of radiation from the antenna and the housing of the radio unit is situated close to the user's ear. In order to get around this problem, it is desirable to lift off the center of radiation some distance from the user's ear.

It is previously known that if a radio unit is supplied with a half-wave dipole antenna, the axis of the field of radiation lies in the middle of the antenna. Consequently, by making the antenna sufficiently long, the field will be moved away from the ear and the intensity of radiation will be considerably reduced near the user's ear and head.

Drawbacks associated with half-wave dipoles and other types of high-impedance fed dipoles are that they are difficult to match in impedance, especially if the intention is that the antenna should cover two or more harmonic bands. If, for example, a half-wave dipole is fed at one of its ends, it requires very high feeding impedances, in the magnitude of 800 ohms. If the dipole is fed at its center part, the feeding impedance is considerably lower, in the magnitude of 70 ohms. With small mobile radio units the antenna is as a rule fed from one of its ends. Simultaneously, the power stage, which is feeding the antenna, is provided with a much lower output impedance, in the magnitude of 50 ohms. To prevent the occurrence of reflections and a low degree of efficiency, the low output impedance of the power stage is to be matched to the high feeding impedance of the antenna. This requires an impedance-matching device be coupled up between the antenna and the power stage. The impedance-matching device may also be called a impedance-adapting device, or shorter, impedance-adapting, impedance-matching or just matching.

Different types of impedance-matching devices are previously known. One previously known type of matching constitutes a transformer with resonant circuits. In principle, a primary part is associated with the output of the power stage and a secondary part, comprising the tuned resonant circuits, with the antenna. The resonant circuits contain a parallel coil and a capacitance. The coil may occasionally be provided with an air core. In one variation of resonant circuits, the core is formed by means of a strip line, which means that a printed board pattern is produced to form the coil. In another variation, the primary winding is omitted and the conductors from the power stage are directly connected to any suitable position on the secondary winding. This solution involves advantages, such as fewer and smaller components which saves space and costs compared to a transformer circuit with both primary and secondary windings. One considerable drawback associated with this solution is its narrow bandwidth.

A further type of impedance-matching involves the use of a helix resonator, which in fact is a filter component, which in extreme cases may function as a tuned oscillation circuit.

In small apparatuses, as for example mobile radio equipment, however, only a small space is offered for an impedance-matching device.

SUMMARY OF THE INVENTION

In order to prevent reflections and a low degree of efficiency, the output impedance of the power stage must be matched to the input impedance of the antenna.

Matching will be needed irrespective of the fact that the power stage/feeding stage is provided with a substantially higher or lower output impedance compared to the input impedance of the input stage. A quotient of the highest and the lowest impedance gives an impedance quotient I. Accordingly, a high impedance quotient means a great difference between the impedances of the input and the output. Previously known impedance-matching devices frequently require a lot of space and/or are complicated in their design. However, in small apparatuses, such as a mobile radio equipment, only a small space is offered for an impedance-matching device.

The present invention offers a solution to an impedance-matching problem, namely impedance-matching of an antenna in a small space with short distances.

Another problem which is solved by the present invention is that sufficient bandwidth is achieved by means of the impedance-matching device.

Still another problem which is solved by the present invention is that an impedance-matching device should be simple and cheap to manufacture.

An object of the invention is to provide an impedance-matching in a strongly limited length and still keep up high demands on precision and bandwidth, and that the invention should be simple and cheap to manufacture.

Briefly, the proposed solution involves matching in several steps by using quarter-wave transformers.

In more detail, the solution is obtained in that quarter-wave transformers are stacked, the dielectric material of which comprises of a material with a dielectric coefficient $\in$ exceeding the value of 10.

By this solution of the problems, a number of advantages are achieved. The impedance-matching device may be manufactured sufficiently small, so as to make it possible to mutually integrate the antenna and the matching device—even in the same housing. The device is especially appropriate for use in radio equipment having junctions with a high impedance quotient (I>3) between circuit-/module stage. It will be clear from the following presentation that the impedance-matching device is simple to manufacture, consists of few parts and therefore is also cheap to manufacture. Despite its small dimensions it provides good frequency characteristics, such as good precision, is easy to tune and is provided with a sufficient bandwidth. Designers and manufacturers are spared from the drawbacks of working with circuits and coils, as these circuit elements are difficult to manufacture with precise values and therefore are associated with severe losses.

The invention will now be described in more detail by means of examples of embodiments and with reference to the accompanying drawings.

DRAWING SUMMARY

PREFERRED EMBODIMENTS

Figure 1:
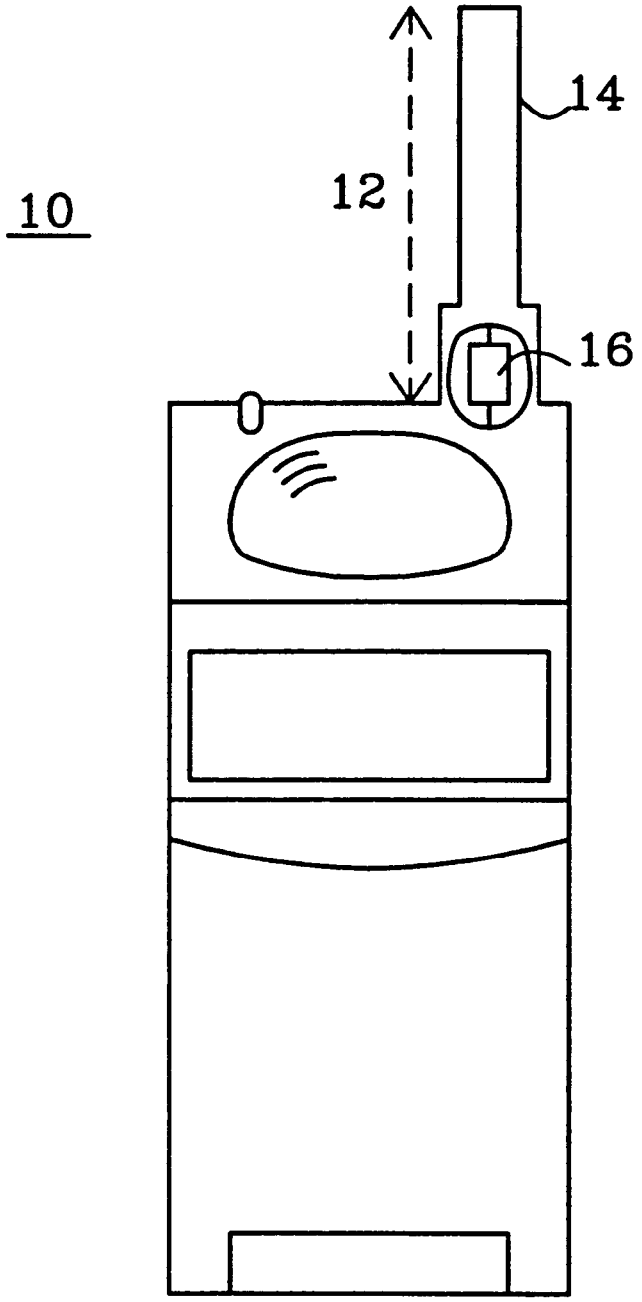
FIG. 1 shows a mobile radio unit having a first exemplary embodiment of an impedance-matching device integrated in the antenna unit.

FIG. 1 shows a mobile radio unit 10 with an integrated antenna unit 12, which is partly cut away in the figure. The antenna unit comprises of an antenna 14 and an impedance-matching device 16. The antenna 14 may be a half-wave dipole antenna, which is fed in one end with radio waves. The feeding impedance is of the magnitude 800 ohms (0.5–1 Kohm). The output stage of the radio unit has an output impedance in the magnitude of 50–100 ohms. With the purpose of matching this big difference in impedances, an impedance-matching device has been connected between the output stage and the antenna. Owing to the small dimensions of the impedance-matching device, it has been integrated with the antenna 25 an antenna unit.

The idea is to perform the matching in steps by coupling up a number of quarter-wave transformers in series, which are made by means of a dielectric material having a high dielectric coefficient but with different distances between outer and inner conductors.

The impedance-matching device will now be described in more detail with reference to FIG. 2. This figure shows a longitudinal section of a first exemplary embodiment of the device. The impedance-matching device 16 includes in this embodiment four quarter-wave transformers 18–24, which are connected in series between a feeding stage in the radio unit 10 and the antenna 14. These transformers are of coaxial type. Each quarter-wave transformer 18–24 comprises an outer conductor 26, also called a screen, composed of an electric conducting material. Close to the inside of the screen is a dielectric material 28, an electric insulating material. The outer conductor and the dielectric material enclose an inner conductor 30. The dielectric material 28 fills up the space between the conductors 26 and 30. Each dielectric material has its own dielectric coefficient $\in$.

As shown in the figure, the inner conductor 30 is formed as a thin shell, i.e. the conductor is tubular. This can be achieved to a sufficient extent by means of metallizing the inside of the dielectric material. This solution means that the quarter-wave transformer is not homogeneous. The shell design is advantageous with respect to the weight aspect. Alternatively, the conductor 30 may be homogeneous but will then also have a heavier weight. In small mobile radio units, weight and dimensions are parameters which are desirable to minimize. The matching device has one high-impedance end/short side 34 and one low-impedance end/short side 32. The expression "high-impedance" is just a relative conception of informing that this end of the device has a higher impedance than the low-impedance end. The high-impedance end is to be connected to the input or output which has the higher impedance relative to the other input or output.

By varying the distance between the outer 26 and the inner conductors 30, and by that the thickness of the therebetween situated dielectric material 28, the impedance of the quarter-wave transformer will also be varied. The greater the distance between the connectors, the higher the impedance. A further variation possibility is to vary the material and by that the dielectric coefficient.

Figure 2:
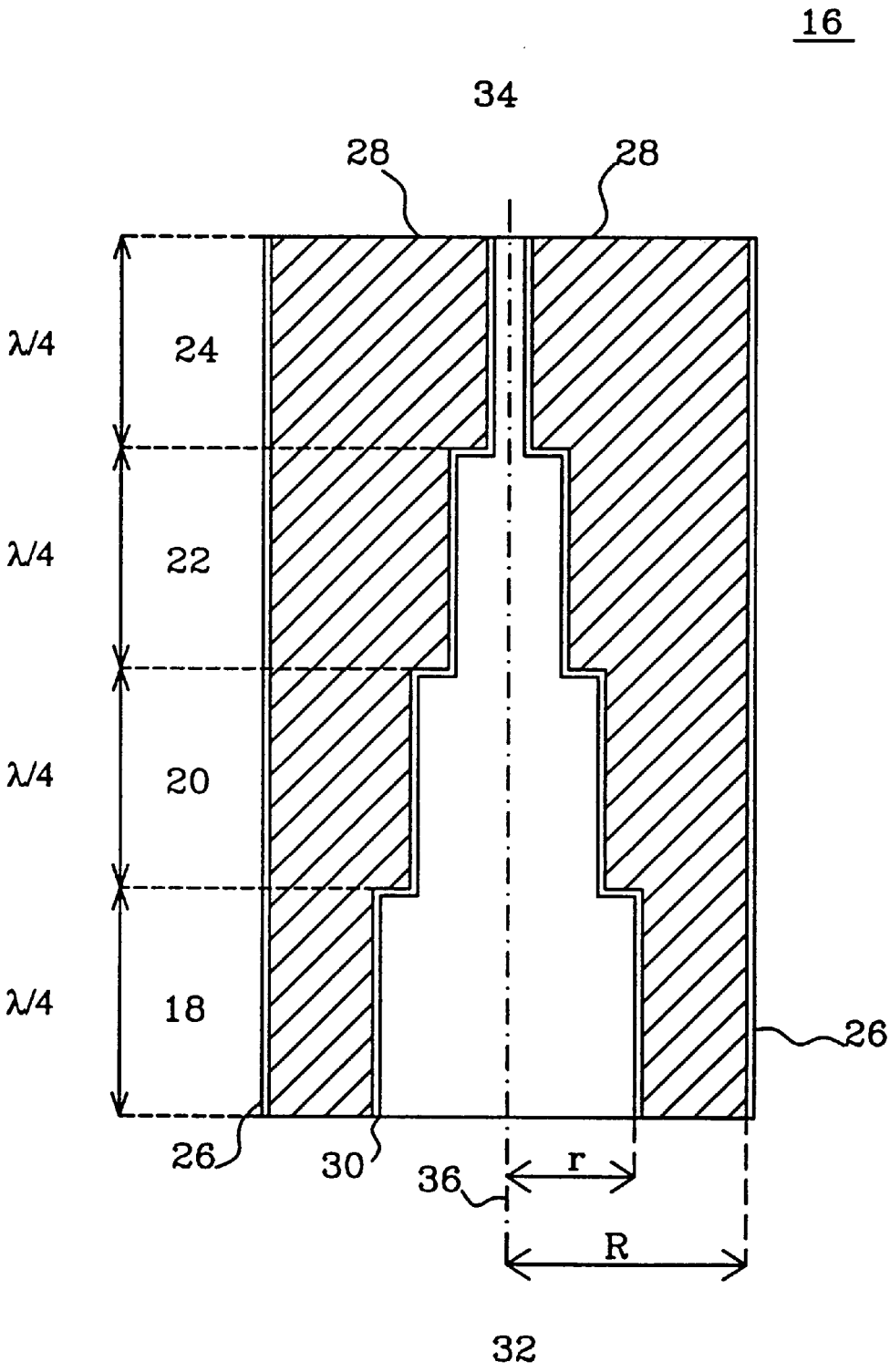
FIG. 2 shows a first exemplary embodiment of the impedance-matching device in section.

In the proposed embodiment according to FIG. 2, the different outer conductors 26 of the quarter-wave transformers 18–24, connected in series, have the same distance to the center line and by that also the outer conductor 26 of the impedance-matching matching device 16 is situated at a constant distance from the center line 36. Since the outer conductor 26 in this case is tubular, having a cross-section which is composed of a circular arc, the distance equals a radius R which is fixed. The inner conductor 26 is made tubular in steps, but the distance to the center line 36 is modified in steps for each new quarter-wave transformer. Due to the fact that the radius r of the inner conductor is reduced in steps for each quarter-wave transformer on the way from the power stage/feeding stage of the radio unit to the attachment of the antenna 14, also the impedance is increased in steps.

Each quarter-wave transformer step (18–24) would, for example, be 9 mm at 900 MHz if a material, having a dielectric coefficient $\in$ of at least the value 80, is used. If the matching is performed in four steps, the matching device would be totally 36 mm high in size. The diameter of the matching device is primarily controlled by the stiffness which the design in question is to have. Due to the fact that it is the relation between the diameter of the inner conductor 30 (the antenna connection) and the diameter of the outer conductor 26 (the screen) which is to be fixed, there is a considerable independence in choosing the dimensions of the matching device, as long as said relationship is fixed. However, it is not advisable to choose too small a diameter for the inner conductor (in the magnitude of 0.01 mm), since the resistive losses increase by decreasing diameter. Low, acceptable resistive losses in the inner conductor are achieved in a copper conductor having a diameter of 0.5 mm.

This proposed solution is very interesting up to 2 GHz. In the frequency band of 1.8 GHz, each transformer step will be only 4.5 mm long. Above the frequency 2 GHz, even other impedance-matchings can for different reasons be of interest.

Figure 8:
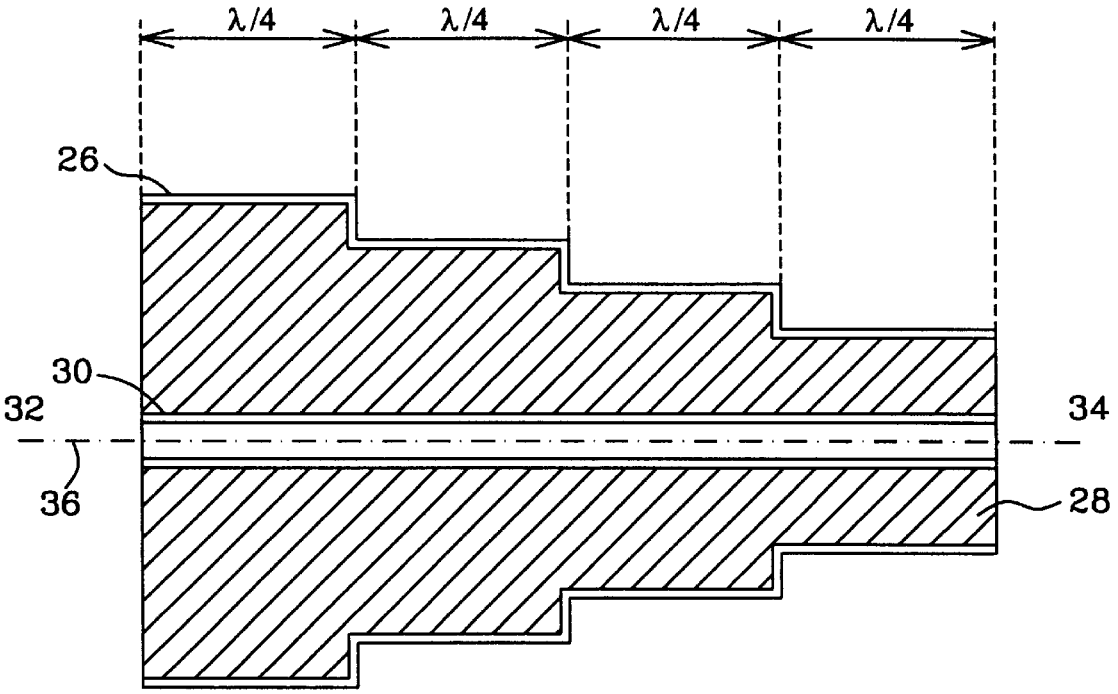
FIG. 8 is an alternate view of the first embodiment of the impedance matching device.

An alternative shaping (see, FIG. 8) of the matching device is achieved by means of keeping the distance between the inner conductor 30 and the center line 36 constant, which means that the distance/the radius between the center line 36 and the outer conductor 26 is changed in steps for each quarter-wave transformer step 18–24.

Figure 3:
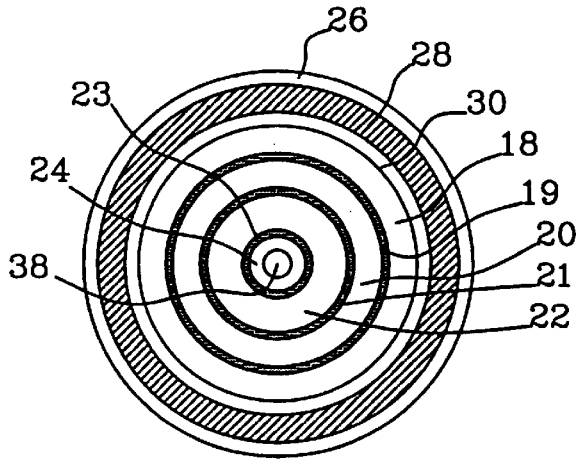
FIG. 3 is a view of the first exemplary embodiment of the impedance-matching device.

FIG. 3 shows the first embodiment of the impedance-matching device 16 when the low-impedance end 32 of the device is turned towards an observer. From outside and in towards the center, the outer conductor 26 is situated first, thereafter the dielectric material 28 and the inner conductor 30, which are parts of the quarter-wave transformer step 18 which has the lowest impedance. After step 18 follow the other transformer steps 20, 22 and 24. Each transformer step is a quarter step and is a quarter of an electric wavelength long. Between each step there is a transition 19, 21 and 23.

Figure 4:
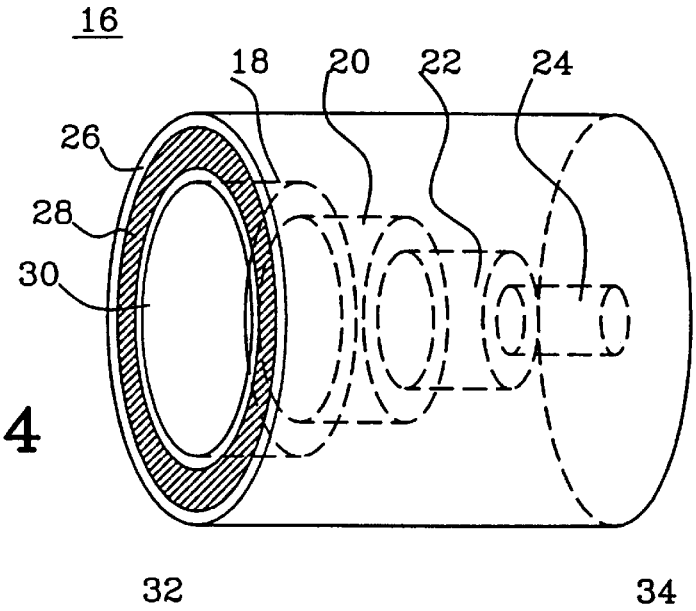
FIG. 4 is a perspective view of the first exemplary embodiment of the impedance-matching device.

FIG. 4 is a cross-sectional view of the first exemplary embodiment. The four transformer steps and their inner limiting areas are disclosed in broken lines in the figure. An extendable antenna may be integrated in the matching device 16 so that the antenna will have its attachment in the center aperture 38 which is formed in the high-impedance step 24. In the inserted position, the antenna pole is extended through the cavity of the matching device which is formed in the middle part of the inner conductor 28.

Figure 5:
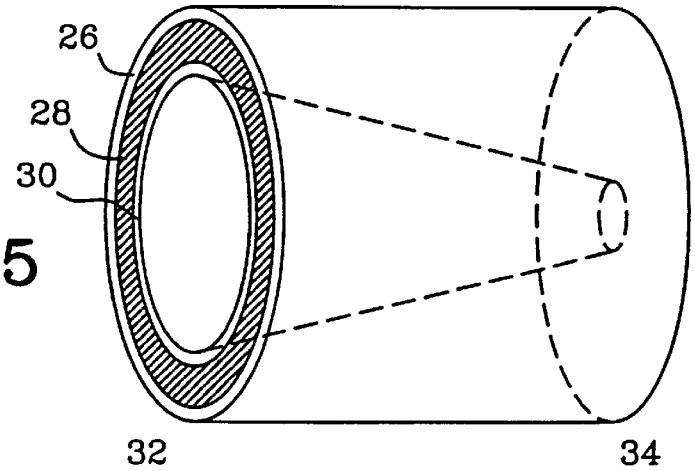
FIG. 5 is a perspective view of a second exemplary embodiment of the impedance-matching device.
Figure 6:
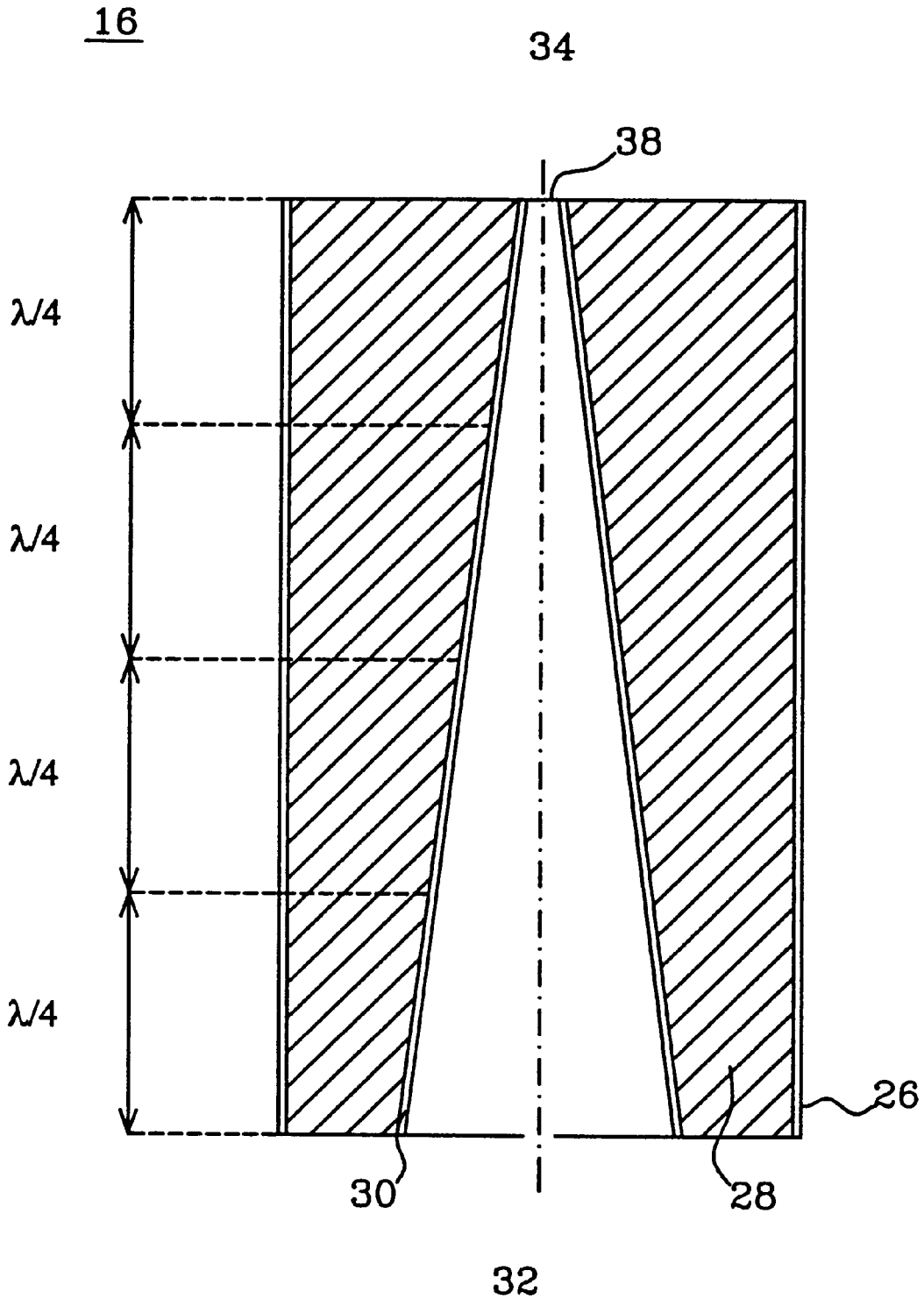
FIG. 6 shows the second exemplary embodiment of the impedance-matching device in section.

FIGS. 5 and 6 show a second exemplary embodiment of the impedance-matching device 16. This exemplary embodiment differs from the first one in that the distance between outer and inner conductors 26 and 30, respectively, is continuously modified instead of step-wise. In other words, the transition between the steps has been formed as a continuous transition.

Figure 9:
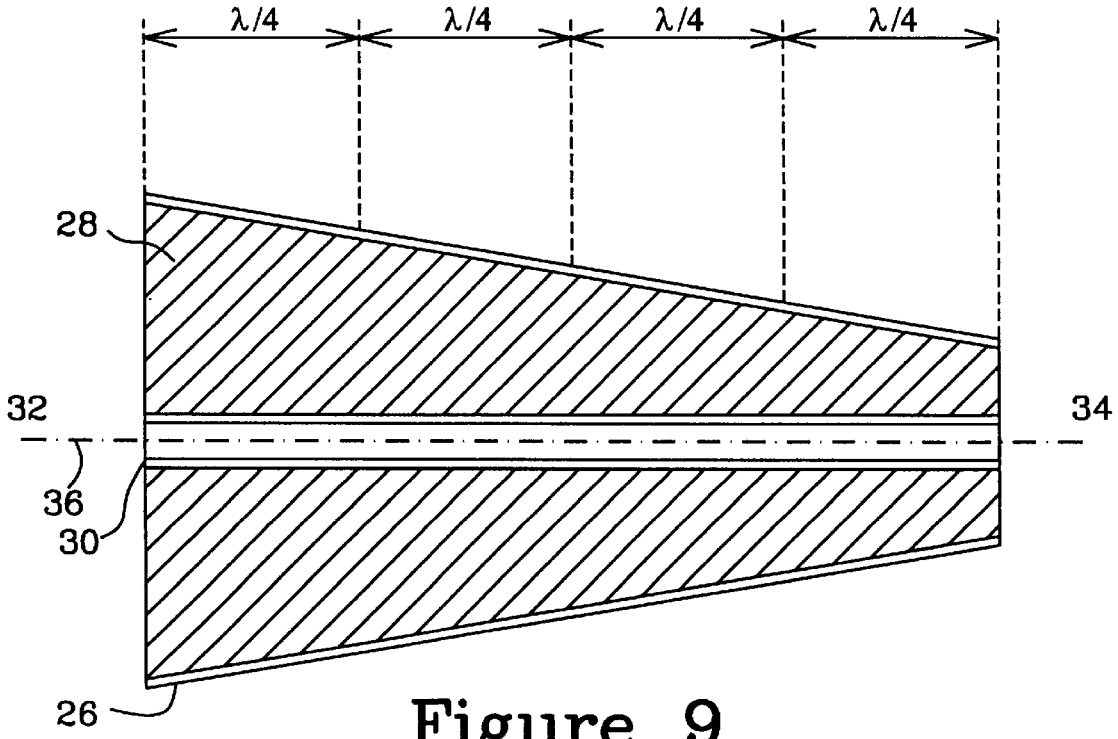
FIG. 9 is an alternate view of the second embodiment of the impedance matching device.

FIG. 5 is a perspective view of the impedance-matching device 16 in which the inner limiting area, the inner area of the inner conductor 30, is drawn in broken lines. The empty space in the middle of the device is conical. Alternatively, the outer conductor 26 may delimit a conical volume while the inner conductor 30 has a fixed radius (see, FIG. 9).

FIG. 6 shows a cross-section of the second exemplary embodiment of the impedance-matching device 16. The modification of the radial distance between outer and inner conductors, 26 and 30, respectively, from the low-impedance short side/end 32 to the high-impedance short side/end 34 is in this case linear. The distance and by that the thickness of the dielectric material at the end of the device which is associated with the lower impedance, e.g. the output impedance of a power stage, of two impedances which are to be matched, is thus less than at the end which is connected to the higher impedance, e.g. the impedance of the antenna side of said device. The radial modification in distance between inner and outer conductors may also be non-linear, which means that the radii of the inner conductor and/or the outer conductor are modified non-linearly in the longitudinal direction of the matching device from the end 32 to the end 34.

A good characteristic of this component is its high degree of efficiency—the unloaded Q-factor, or the so-called quality factor is high. In the case when the impedance-matching occurs in one single step, a high unloaded Q-factor of 16 is achieved (the quotient between the feeding impedance 800 ohms and the output impedance 50 ohms). If the matching to the contrary is carried out in several steps, a lower loaded Q-factor is achieved. In the first embodiment, the matching is carried out in four steps with a doubled impedance for each step (from 50 to 800 ohms), which means that the loaded Q-factor will be 8=4 (steps)×2(Q-factor/step). Accordingly, the Q-factor has been reduced by half compared to the factor for the impedance-matching which is carried out in one step.

Figure 7:
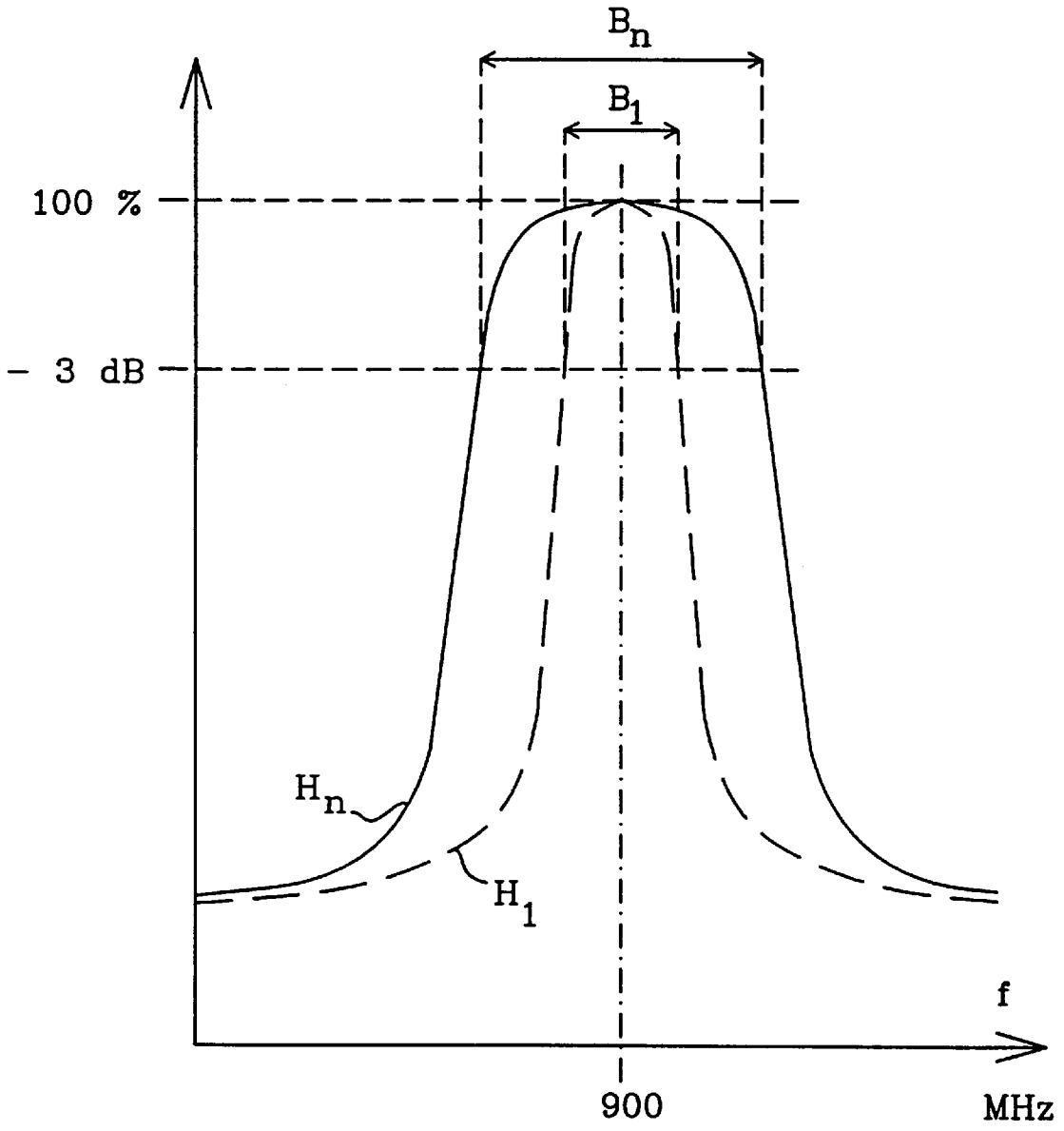
FIG. 7 is a characteristic graph which illustrates how the bandwidth is influenced by different types of impedance-matching.

A matching carried out in one single big step means that the solution will be of a narrow bandwidth while a solution which means a matching carried out in several steps involves a matching having a broad bandwidth. The number of transformer steps is determined by means of the desired bandwidth of the system. FIG. 7 discloses a curve characteristic which illustrates how the frequency curve is changed if the matching is carried out in one or several steps. The curve $H_1$ drawn in broken lines specifies the losses associated with a matching in one single step. The maximum of the curve lies at a center frequency of 900 MHz. Optimized matching (100%) means no impedance losses at the center frequency. The matching losses increase rapidly with increasing distance from the center frequency. The bandwidth is measured between the points where the curve cuts the −3 dB line. The single step matching ($H_1$) has a narrow bandwidth $B_1$. The curve $H_n$ drawn with a continuous line specifies the losses associated with a matching in several steps. At an attenuation of −3 dB, the bandwidth $B_n$ is considerably broader than in the single step case. In mobile radio applications, it is important that the bandwidth is so broad that the RX- and TX-frequency bands, respectively, are situated clearly within the bandwidth of the matching device.

The proposed impedance matching device may be combined with different types of antennas. The device is consequently not limited only to half-wave-dipoles. Neither are there any difficulties associated with a modification of the device to fit retractable antennas.

The impedance-matching device 16 may be manufactured by means of a very simple method. The dielectric material is die-casted which means that the device is formed in one piece at high pressure and high temperature. A suitable choice of material for die-casting is ceramic materials. Ceramic materials are sintered, nonconducting materials which look like glass. Ceramic materials are salt mixtures of metal oxides of Barium, Mangan, Cobolt, etc. During the casting, dielectric materials with a high dielectric coefficient ($\in$=10) are produced. Different compositions of metal oxides give new ceramic materials with different dielectric coefficients. The walls of the finished component of dielectric material are covered, coated or sprayed with metal or alternatively dipped in a metal bath. Then the solidified metal forms outer and inner conductors. Dependent on what is desired, the inner conductor may be made homogeneous or hollow.

Quarter-wave transformers have previously not been of any particular interest for use in small radio units. The invented design means that it is possible to manufacture impedance matching devices with sufficiently small dimensions to be of interest for application in small radio units. Materials with a dielectric coefficient $\in$ which exceeds 10, as e.g. ceramic materials, are an important part of the design. The invented matching device may be included in a number of different radio equipments and devices for radio communication. Examples of such devices are terminals and micro base stations for mobile radio communication as well as GPS-equipment, such as satellite receivers.

The invention is of course not limited to the embodiments described above and shown in the drawing, but can be modified within the scope of the accompanying claims.

What is claimed is:

1. An extendable antenna assembly comprising an extendable antenna members; and an impedance-matching device integrally formed within the extendable antenna member, the device comprising, at least two quarter-wave transformers connected in series, each of said at least two quarter-wave transformers having a different output impedance, wherein said at least two quarter-wave transformers comprise coaxial transformers with an inner conductor and an outer conductor with a dielectric material located there between, and wherein the radius of each outer conductor of each transformer is substantially equal, and wherein the radius of the inner conductor varies continuously forming a substantially conical shape.

2. An extendable antenna assembly comprising:

an extendable antenna member; and an impedance-matching device integrally formed within the extendable antenna member the device comprising, at least two quarter-wave transformers connected in series, each of said at least two quarter-wave tranformers having a different output impedance, wherein said at least two quarter-wave transformers comprise coaxial transformers with an inner conductor and an outer conductor with a dielectric material located there between, wherein each inner conductor of each coaxial transformer has a same radius, and wherein each outer conductor of each coaxial transformer has a radius that varies continuously forming a substantially conical shape.

3. An impedance-matching device comprising:

at least two quarter-wave transformers connected in series, each of said at least two quarter-wave transformers having a different output impedance, wherein said at least two quarter-wave transformers comprise coaxial transformers with an inner conductor and an outer conductor with a dielectric material located there between, wherein said dielectric material of each of said at least two quarter-wave transformers has a different coefficient.

4. The impedance-matching device according to claim 3, wherein each succeeding quarter-wave transformer in the series has a higher output impedance than the output impedance of the immediately preceding quarter-wave transformer in the series.

5. The impedance-matching device according to claim 3, wherein each succeeding quarter-wave transformer in the series has a lower output impedance than the output impedance of the immediately preceding quarter-wave transformer in the series.

6. The impedance-matching device according to claim 3, wherein the input impedance of each succeeding quarter-wave transformer in the series is different than the output impedance of the immediately preceding quarter-wave transformer in the series.

7. The impedance-matching device according to claim 3, wherein the input impedance of each succeeding quarter-wave transformer is substantially continuous with the output impedance of the immediately preceding quarter-wave transformer in the series.

8. The impedance-matching device according to claim 3, wherein the coaxial transformers are homogeneous.

9.The impedance-matching device according to claim 3, further comprising an extendable antenna integrated within said impedance-matching device.

10. The impedance matching device according to claim 9, wherein said antenna comprises a half-wave dipole antenna.

* * * * *

UNITED STATES PATENT AND TRADEMARK OFFICE

CERTIFICATE OF CORRECTION

PATENT NO. : 6,222,500 B1
DATED : April 24, 2001
INVENTOR(S) : Koitsalu et al.

It is certified that error appears in the above-identified patent and that said Letters Patent is hereby corrected as shown below:

Column 3,
Line 29, replace "25" with -- as --

Column 6,
Line 46, replace "comprising" with -- comprising: --
Line 47, replace "members" with -- member --

Signed and Sealed this

Eighth Day of January, 2002

*Attest:*

*Attesting Officer*

JAMES E. ROGAN
*Director of the United States Patent and Trademark Office*